US005725613A

United States Patent [19]

Reeves et al.

[11] Patent Number: 5,725,613

[45] Date of Patent: Mar. 10, 1998

[54] METHOD TO REDUCE OXIDATIVE DETERIORATION OF BULK MATERIALS

[75] Inventors: Robert A. Reeves, Arvada; Mark H. Berggren, Golden; Charlie W. Kenney, Littleton, all of Colo.

[73] Assignee: Hazen Research, Inc, Golden, Colo.

[21] Appl. No.: 677,637

[22] Filed: Jul. 8, 1996

[51] Int. Cl.[6] ..... C10L 9/00

[52] U.S. Cl. ..... 44/501; 44/591; 44/592; 44/620

[58] Field of Search ..... 44/501, 620

[56] References Cited

U.S. PATENT DOCUMENTS

| | | | |
|---|---|---|---|
| 3,243,889 | 4/1966 | Ellman et al. | 34/9 |
| 4,083,940 | 4/1978 | Das | 44/620 |
| 4,170,456 | 10/1979 | Smith | 44/1 |
| 4,396,394 | 8/1983 | Li et al. | 44/1 |
| 4,401,436 | 8/1983 | Bonnecaze | 44/1 |
| 4,511,363 | 4/1985 | Nakamura et al. | 44/501 |
| 4,599,250 | 7/1986 | Cargle et al. | 427/220 |
| 4,613,429 | 9/1986 | Chiang et al. | 209/5 |
| 4,650,495 | 3/1987 | Yan | 44/1 |
| 4,797,136 | 1/1989 | Siddoway et al. | 44/501 |
| 4,828,575 | 5/1989 | Bellow, Jr. et al. | 44/501 |
| 4,828,576 | 5/1989 | Bixel et al. | 44/501 |
| 5,087,269 | 2/1992 | Cha et al. | 44/501 |

OTHER PUBLICATIONS

Edwards, 1995, *Catalysis Today*, 23:59–66.

Keim, "Industrial Uses of Carbon Dioxide", in *Carbon Dioxide as a Source of Carbon*, M. Aresta and G. Forti, eds., D. Reidel Publishing Co., 1987, 23–31.

Rigsby et al., "Coal self-heating: problems and solutions", pp. 102–106.

Riley et al., *J. Coal Quality*, Apr. 1987, pp. 64–67.

Ripp, "Understanding coal pile hydrology can help BTU loss in stored coal", pp. 146–150.

Sapienze et al., "Carbon Dioxide/Water for Coal Beneficiation", in *Mineral Matter and Ash in Coal*, 1986 America Chemical Society, pp. 500–512.

*Primary Examiner*—Ellen M. McAvoy
*Attorney, Agent, or Firm*—Sheridan Ross P.C.

[57] ABSTRACT

Disclosed is a method to reduce oxidative deterioration of bulk materials. Preferred embodiments of bulk materials include solid fuel materials, such as coal, and bulk food products. The method includes contacting a bulk material with a heat transfer medium to reduce the temperature of the bulk material below ambient temperature, and preferably below about 10° C. In this manner, the rate of oxidation is sufficiently low so that significant losses, such as the loss of thermal values in of fuel material, are avoided. The heat transfer medium can be solid or fluid and in a preferred embodiment is liquid carbon dioxide or liquid nitrogen.

42 Claims, No Drawings

METHOD TO REDUCE OXIDATIVE DETERIORATION OF BULK MATERIALS

FIELD OF THE INVENTION

The present invention relates to a method and composition for reducing the oxidative deterioration of bulk materials. In particular, the invention relates to reduction of oxidative deterioration of solid fuel materials, such as coal.

BACKGROUND OF THE INVENTION

When bulk materials contact the ambient environment, they are subject to oxidative deterioration because of contact with oxygen in air. Such oxidative deterioration can have many negative effects. For example, when a solid fuel material, such as coal, is being transported from a mine to a utility or is in storage at a utility, it is subject to oxidation. One negative aspect of such oxidative deterioration is a loss in the thermal value of the coal. Depending on the type of coal and its water content, among other factors, between 1% and 5% of the thermal value of coal can be lost from the time it is mined until the time at which it is consumed. These losses are sizeable in the domestic United States utility industry which consumes about 800 million tons of coal per year. Such losses are particularly significant for low rank coals such as lignite and sub-bituminous coals, especially for such materials which have been upgraded by thermal treatment to reduce moisture.

Moreover, low level oxidation of coal generates heat and as such a reaction progresses, there is a significant risk of certain coal materials self-igniting, resulting in a risk to property and life.

Most efforts to reduce oxidative deterioration have focused on reducing the risk of self-heating and thereby self-ignition of coals. The problem has been addressed by a variety of approaches. One such approach is by compacting coal as it is transported or stored. By compacting coal, significant reductions in coal surface area which contact the ambient environment can be attained. Such a reduction of surface area contact reduces the amount of coal available for oxidation by the ambient environment. Another approach has been to flatten and trim coal piles to decrease the ability of the coal pile to hold heat and therefore generate enough heat through self-heating to self-ignite. In addition, contacting coal materials with various fluids, such as hydrocarbon-based materials, has been used.

While the more chronic problem of loss of economic value of bulk materials, such as the loss of heating values in coal, has been recognized and studied, adequate widespread use of strategies for significantly reducing economic losses from this problem have not been achieved. Therefore, a need exists for reducing the oxidative deterioration of bulk materials.

SUMMARY OF THE INVENTION

The present invention includes a method to reduce oxidative deterioration of bulk materials, particularly including oxidizable and highly reactive bulk materials. In preferred embodiments, the bulk materials in question include solid fuel materials, bulk food products, sulfide ores and carbon containing materials such as activated carbon and carbon black. In further preferred embodiments, the solid fuel material can be coal, upgraded coal products, oil shale, solid biomass materials, refuse-derived (including municipal and reclaimed refuse) fuels, coke, char, petroleum coke, gilsonite, distillation by-products, wood by-product wastes, shredded tires, peat and waste pond coal fines.

The method includes directly contacting the bulk material with a heat transfer medium to reduce the temperature of the bulk material below an ambient temperature. In a preferred embodiment, the temperature of the bulk material is reduced to below about 10° C. In this manner, significant oxidative deterioration of the bulk material is avoided. In the instance of a solid fuel material, for example, loss of the thermal value of the solid fuel material is reduced because the rate of oxidative deterioration significantly slows with cooler temperatures. Significant reductions in the rate of loss of heating value can be attained for solid fuel material. For example, fuel materials treated with the method of the present invention can have a rate of loss of heating value of less than about 0.5% per month.

The heat transfer medium can be solid, liquid or gas and is substantially inert to the bulk material. In preferred embodiments, the heat transfer medium can be carbon dioxide, carbon monoxide, helium, nitrogen, argon or air. In preferred embodiments, the heat transfer medium is carbon dioxide or nitrogen, in particular, liquid and solid carbon dioxide and liquid nitrogen.

The present invention includes conducting the process of contacting a bulk material with a heat transfer medium at a variety of times throughout the product life of the bulk material. For example, the process can be conducted during time periods when the bulk material is subject to a high degree of mixing such as during size reduction steps and/or loading or unloading of the bulk material. In an alternative embodiment, the step of contacting the bulk material with the heat transfer medium can be conducted while the bulk material is in a static state, such as in a storage pile.

Further embodiments of the present invention include compositions which have been produced by conducting the method of the present invention. Such compositions, for example, include bulk materials in direct contact with a heat transfer medium having temperatures within ranges according to the method of the present invention.

DETAILED DESCRIPTION

The present invention concerns a method to reduce oxidative deterioration of bulk materials. The term "bulk materials" refers to any solid materials which are produced, shipped and/or stored in quantities measured on a tonnage basis, and preferably includes oxidizable and highly reactive materials. Bulk materials can include solid fuel materials, bulk food products, sulfide ores and carbon containing materials, such as activated carbon and carbon black.

Solid fuel material, as used herein, generally refers to any solid material which is combusted for some useful purpose. More particularly, solid fuel materials can include coal, upgraded coal products, and other solid fuels. The term coal includes anthracite, bituminous coal, sub-bituminous coal and lignite. The present invention is particularly suited for bituminous coal, sub-bituminous coal and lignite. The term upgraded coal product includes thermally-upgraded coal products, coal products produced by beneficiation based upon specific gravity separation, mechanically cleaned coal products, and sized coal products such as stoker, breeze, slack and fines. The present invention is particularly suited for thermally-upgraded coal because of significantly increased risk of oxidative deterioration and/or self-ignition. Thermally upgraded products are likely to have a higher rate of oxidation because of formation of reactive components which increases the rate of oxidation. In addition, such materials typically have had water removed to a significant extent. If such materials are subsequently exposed to humid environments, the materials will rewet, thereby generating heat through the heat of hydration.

Examples of other solid fuels embodied in the present invention include, but are not limited to, oil shale, solid biomass materials, refuse-derived (including municipal and reclaimed refuse) fuels, coke, char, petroleum coke, gilsonite, distillation by-products, wood by-product wastes, shredded tires, peat and waste pond coal fines. The term solid biomass can include, for example, wood wastes, agricultural wastes, and grass. The term refuse-derived fuels can include, for example, landfill material from which non-combustible materials have been removed.

In one embodiment of the present invention, bulk materials include bulk food products. Such bulk food products include food products that tend to deteriorate in storage. Since the food industry has concentrated on preservation of high-end food products such as meats, dairy and vegetables, there remains a need in the industry for low cost, effective preservation of bulk food products such as bulk grains and related by-products. According to the present invention, bulk food products can include bulk grains, animal feed and related by-products. Examples of such bulk grains include, but are not limited to wheat, corn, soybeans, barley, oats, and any other cereal grain that deteriorates in storage.

Examples of other oxidizable and highly reactive solid bulk materials embodied in the present invention include, but are not limited to sulfide ores, and carbon containing materials, such as activated carbon and carbon black.

The present method includes directly contacting the bulk material with a heat transfer medium to reduce the temperature of the bulk material below ambient temperature. The term ambient can refer to the temperature of the environment in which the bulk material is produced, shipped and/or stored. Alternatively, such term can include the temperature at which the material existed prior to production. For example, the temperature of coal in the earth is relatively constant and will vary between about 10° C. and about 16° C. In a preferred embodiment, the method of the present invention includes reducing the temperature of the bulk material with a heat transfer medium to below about 10° C., preferably below about 5° C., more preferably below about 3° C., and even more preferably between about 0° C. and about 3° C. According to the present invention, reference to the temperature of the bulk material can include the temperature of an interior, such as the core of the material, and/or a surface portion of the material. More particularly, the temperature of the bulk material can refer to the temperature of a portion of the material which is or can be in contact with air or oxygen.

The appropriate temperature for cooling a bulk material by contact with a heat transfer medium pursuant to the present invention is selected such that unacceptable levels of oxidative deterioration and/or self-heating are avoided. The determination of the appropriate temperature may depend on a variety of factors, including the nature of the bulk material, the available time until consumption (i.e. storage time), the rate of oxidation of the bulk material at various temperatures, the cost of the heat transfer medium, and the effects of extraneous factors on the product such as material handling protocols.

The heat transfer medium of the present invention can be solid or fluid (i.e., liquid or gas). The heat transfer medium is essentially non-oxidizing to the bulk material. It should be noted that when considering whether the heat transfer medium is non-oxidizing with regard to the bulk material, the temperature of the heat transfer medium must be considered. For example, warm air may be overly reactive with some bulk materials, such as coal, but if the heat transfer medium is cold air (e.g., 4° C.), the degree of reactivity with the coal may be acceptably low to be considered non-oxidizing. Preferably, to be considered non-oxidizing, the heat transfer medium of the present invention should not oxidize the product or cause the product to become more reactive to oxygen at a time subsequent to treatment with the heat transfer medium. In a further embodiment, the heat transfer medium can be inert (i.e., non-reactive) to the bulk material.

The heat transfer medium needs to be sufficiently cold so that the temperature of the bulk material, prior to contact with the heat transfer medium, can be reduced to within the appropriate temperature range after contact. In a preferred embodiment, the temperature of the heat transfer medium prior to contact with the bulk medium is less than about −30° C., more preferably less than about −50° C. and most preferably less than about −70° C.

The heat transfer medium can comprise carbon dioxide, carbon monoxide, helium, nitrogen, argon, or air. More preferably, the heat transfer medium can comprise carbon dioxide, carbon monoxide, nitrogen or argon. In a preferred embodiment, the heat transfer medium can comprise either nitrogen or carbon dioxide. In a further preferred embodiment, the heat transfer medium can comprise liquid or solid carbon dioxide or liquid nitrogen. It will be recognized that for a liquid or solid heat transfer medium which is a gas at ambient temperatures of the bulk material, as the heat transfer medium heats up, it will change phase to become a gas. Such an evolution of gas over time, such as the evolution of carbon dioxide gas from solid carbon dioxide, has the benefit of excluding oxygen from contacting the bulk material.

It will be appreciated that in the instance of a solid heat transfer medium, smaller particle sizes will allow more uniform cooling than for larger particle sizes. In the instance of a solid heat transfer medium, the particle size of the medium is preferably less than about 5 millimeter, more preferably less than about 3 millimeter and most preferably less than about 0.5 millimeter.

The step of contacting includes bringing the heat transfer medium and the bulk material into sufficiently intimate contact such that the bulk material is cooled to the desired temperature. By contacting the bulk material directly with the heat transfer medium, the heat transfer which occurs to cool the bulk material is more efficient than through an indirect heat transfer. Since the heat transfer medium is not confined within, for example, tubes of a heat exchanger, a more complete, effective and uniform cooling of the bulk material can be achieved. Specific preferred methods for contacting the heat transfer medium with the bulk material are described in detail below.

It will be understood that the amount of heat transfer medium needed to cool a given amount of bulk material will depend on various factors, including the relative temperatures of each. However, in a preferred embodiment, the amount of heat transfer medium to be contacted with a bulk material will be between about 0.5 and about 10 weight percent, more preferably between about 1 and about 5 weight percent, and even more preferably between about 1 and about 2 weight percent based on the weight of the bulk material.

The step of contacting a bulk material with a heat transfer medium of the present invention is preferably conducted substantially in the absence of water. It will be recognized that many bulk materials and heat transfer media contain some naturally occurring water. Reference to conducting the present process in the absence of water refers to no water being introduced in addition to any moisture naturally occurring in the bulk material or heat transfer media.

A preferred embodiment of the present invention further includes maintaining the bulk material at a cooled temperature as described above for a time of at least about one day, more preferably at least about one month and more preferably at least about six months. For example, by maintaining such temperatures for such time periods, oxidative deterioration can be reduced during processing, transport and storage of bulk materials.

The method of the present invention which includes contacting a bulk material with a heat transfer medium to effectively reduce the temperature, can be used in combination with other techniques for reducing oxidative deterioration and/or self-heating. For example, methods of the present invention can further include sizing the bulk material by removing small particles therefrom. In this manner, the effective surface area of the bulk material available as an oxidative surface is decreased. More particularly, this step can include removing particles of the bulk material having a particle size of less than about 5 millimeter.

In addition, methods of the present invention can also include the step of compacting the bulk material. In this manner, the available surface area for contact with ambient air is reduced. More particularly, the step can include compacting the bulk material to a bulk density of greater than about 700 kg/m$^3$, and more preferably to a bulk density of greater than about 1000 kg/m$^3$.

Methods of the present invention will reduce the oxidative deterioration of the bulk material in question. In the instance where the bulk material is a solid fuel material, one measure of the effectiveness of reducing oxidative deterioration is measuring the rate of loss of the heating value of the fuel material. For example, thermal loss can be measured by comparing the moisture-ash-free heating value (MAF heating value) of coal before and after storage. The MAF heating value is computed by subtracting the dilution effects of non-combustible ash and moisture from a heating value measured on whole material by a laboratory calorimeter. The MAF heating value is primarily a component of the hydrogen and carbon in the coal. These two components are oxidized to water vapor and carbon dioxide during storage. Oxidation of hydrogen and carbon through low temperature oxidation will reduce the MAF heating value.

In a preferred embodiment of methods of the present invention, solid fuel material treated by methods of the present invention has a rate of loss of heating value of less than about 0.5% per month when stored at 2° C. in air, and in a more preferred embodiment, the solid fuel material has a rate of loss of heating value of less than about 0.1% per month, and in a more preferred embodiment the solid fuel material has a rate of loss of heating value of less than about 0.05% per month.

In the instance where the bulk material is a bulk food product, such as bulk grain, other means of measuring the effectiveness of reducing oxidative deterioration can be employed. For example, a reduction in the concentration of micro-organisms on grain could be used as a measurement of the effectiveness of reducing oxidative deterioration in the grain. The effectiveness of reducing oxidative deterioration in a bulk food product could also be measured as a percentage of spoilage of the food product over a given period of time.

In a further preferred embodiment of the present invention where the heat transfer medium is not air, the step of contacting the bulk material with a heat transfer medium displaces ambient air from contact with the bulk material. In this manner, the available oxygen for oxidation of the bulk material is reduced.

In a further preferred embodiment of the present invention, the heat transfer medium reacts with the surface of the solid fuel material to passivate the solid fuel material from oxidation by ambient air. Such a heat transfer medium can, for instance, form new compounds on the surface of the solid fuel material such that the surface is inactive, or less reactive to oxidation by ambient air.

Methods of the present invention, including contacting a bulk material with a heat transfer medium, can be conducted at any time in the product life of the bulk material in question to reduce oxidative deterioration in the future. For example, in the case of solid fuel material such as coal, the step of contacting can be conducted at any time from when the fuel is removed from the ground or otherwise produced, until it is ultimately consumed at a utility.

The method of contacting a bulk material with a heat transfer medium is preferably conducted at a point in the product life of the bulk material when the bulk material is subject to a high degree of mixing or agitation for some other purpose. In this manner, efficient contact of the bulk material with the heat transfer medium can occur without the added requirement of inducing substantial mixing or agitation solely for the purpose of contact with the heat transfer medium. In one embodiment, the step of contacting can occur when the particle size of a bulk material is being reduced. For example, in the instance of a solid fuel material such as coal, the step of contacting can be conducted at the mine at which the coal is recovered. Such a step of contacting is advantageously conducted when run-of-mine coal is initially crushed. As the run-of-mine coal is introduced into a crusher, a stream of fluid heat transfer medium, preferably liquid carbon dioxide or liquid nitrogen, can be introduced at the same time. In this manner because the crusher induces vigorous mixing of coal particles, intimate contact and mixing of the heat transfer medium with the coal is also achieved. In addition, or alternatively, a solid heat transfer medium such as solid carbon dioxide can be introduced at a mine location such as during a crushing step or subsequent to the crushing as coal is loaded into a transport vehicle (i.e., rail car or barge).

In a further preferred embodiment, the heat transfer medium can be contacted with a bulk material when the bulk material is subject to any material handling or processing operation, such as when being transferred from one storage or transport apparatus to another, such as during loading or unloading from or to a transport vehicle or a storage facility. For example, in the case of coal, which is transported by rail or barge, when it arrives at a utility the coal is either immediately consumed or sent to short- or long-term storage. In any event, as the coal is unloaded from the rail or barge vehicle, it is typically unloaded in such a manner that the solid particulate coal becomes temporarily dispersed. At this point in the unloading process, it is an advantageous time for contacting with the heat transfer medium because of the high degree of mixing available to achieve intimate contact and efficient cooling. Thus, a fluid and/or solid heat transfer medium, such as liquid or solid carbon dioxide or liquid nitrogen, can be introduced at this point in a material transfer process. For example, coal is typically unloaded from a barge by scraping the coal from the cargo hold by a bucket elevator or clamshell and is loaded onto a conveyor.

At a transfer point, e.g., between two conveyors downstream of the unloading process, a heat transfer medium such as liquid carbon dioxide or liquid nitrogen can be added to the coal before the coal is placed in storage.

In addition to conducting the method of the present invention when the bulk material is subject to a high degree of mixing or agitation, the step of contacting can be conducted when the bulk material is static. For example, in the instance of a solid fuel material, such as coal, which is in a storage pile, the method of the present invention can include contacting the heat transfer medium with the coal while it is in storage or otherwise in a static condition. Such a step of contacting can be achieved, for example, by inserting a pipe or other distribution device into various points throughout a storage pile and injecting an appropriate amount of, for example, liquid carbon dioxide until appropriate cooling of the coal pile is attained.

In the case wherein the bulk material is a bulk food product, addition of a heat transfer medium is ideally performed such that the food product is not crushed or damaged. Therefore, the heat transfer medium can be contacted with the bulk food product by adding such heat transfer medium at a material handling transfer point during the shipping and unloading of the food product.

In a further preferred embodiment, in the instance of solid fuel materials, such as coal or upgraded coal products, the heat transfer medium is liquid and/or solid carbon dioxide. In this embodiment, carbon dioxide is recovered from the flue gases at a utility by conventional stripping technology. The carbon dioxide is then liquified or frozen solid and then used, as described above, for contacting with coal or upgraded coal product supplies which are incoming during unloading from a transport vehicle or which are already in storage.

Further embodiments of the present invention include compositions which are produced by the processes of the present invention. Such compositions include any of the various bulk materials, as described above, which have been contacted with an appropriate heat transfer medium, as generally disclosed above, and cooled to a temperature within the ranges as described above to reduce the oxidative deterioration of the bulk material.

The following examples are provided for purposes of illustration only and are not intended to limit the scope of the invention.

EXAMPLES

Example 1

This example evaluates the rate of oxygen adsorption of coal at different temperatures as a model to evaluate the effect of cooling on oxidative deterioration of fuel materials.

Four 100-gram samples of ¾-inch coal was obtained from the Powder River Basin in Wyoming, U.S.A. Two of the samples were dried for 16 hours under a warm inert nitrogen atmosphere to reduce the moisture content of the coal from approximately 27% to 6.27%. The remaining two samples were not thermally treated. The samples contained, on a dry basis, 7% ash, 44% volatile matter, 71% carbon, 4.8% hydrogen, 0.6% sulfur and 11,820 BTU/lb.

Each of the four samples of coal was placed in an airtight, 1-liter capacity, stainless steel test vessel. Each vessel was fitted with an electronic solid-state pressure gauge capable of measuring internal air pressure to within 0.015 psi, and a septum fitting to allow air to be admitted to the vessel by syringe. Two of the vessels were placed in a circulating water bath maintained at 24° C. The other two vessels were placed in an ice chest filled with ice and liquid water to maintain the contents at 0° C. One of the dried samples was placed in a 24° C. vessel and one in a 0° C. vessel. One untreated sample was placed in a 24° C. vessel and in a 0° C. vessel. The initial pressures within each vessel were adjusted to 760 mm Hg (1 atmosphere at sea level). Air pressure readings were read twice a day for 72 hours. Air pressure decreases were reflective of oxygen adsorption by the coal. Thus, air pressure decreases simulated the tendency of coal to oxidize and therefore, the loss of thermal heating value. The rates of oxygen adsorption are shown below in Table 1.

TABLE 1

Rate of Oxygen Adsorption, k, for 24° C. and 0° C. Raw and Dried PRB Coal

| Sample | 24° C. | 0° C. | Percent reduction by cooling |
|---|---|---|---|
| Raw PRB Coal | 0.0081 | 0.0034 | −58% |
| Dried PRB Coal | 0.0138 | 0.0021 | −85% |

It will be noted that a reduction in the rate of oxygen adsorption of 85% was achieved by cooling the dried coal from 24° C. to 0° C. Similarly, a 58% reduction was seen with the untreated raw coal. This example illustrates that significant reductions in oxidative deterioration of fuel materials can be achieved by practice of the present invention.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims.

What is claimed is:

1. A method to reduce oxidative deterioration of solid fuel material comprising particles having a size of greater than about 5 mm, said method comprising the steps of:

directly contacting said solid fuel material with a heat transfer medium, wherein said heat transfer medium is not air; and reducing a temperature of said solid fuel material below about 10° C. through said contacting step.

2. A method as claimed in claim 1, wherein the temperature of said solid fuel material is reduced to below about 5° C.

3. A method, as claimed in claim 1, wherein the temperature of said solid fuel material is reduced to be between about 0° C. and about 3° C.

4. A method, as claimed in claim 1, wherein said solid fuel material is selected from the group consisting of coal, upgraded coal products, oil shale, solid biomass materials, refuse-derived fuels, coke, char, petroleum coke, gilsonite, distillation by-products, wood by-product wastes, shredded tires, peat and waste pond coal fines.

5. A method, as claimed in claim 1, wherein said solid fuel material comprises coal and wherein said coal is selected from the group consisting of bituminous coal, sub-bituminous coal and lignite.

6. A method, as claimed in claim 1, wherein said solid fuel material is an upgraded coal product and wherein said upgraded coal product is selected from the group consisting of thermally upgraded products, products beneficiated by specific gravity separation, mechanically cleaned coal products and sized coal products.

7. A method, as claimed in claim 1, wherein said heat transfer medium is selected from the group consisting of carbon dioxide, carbon monoxide, helium, nitrogen, argon and air.

8. A method, as claimed in claim 1, wherein said heat transfer medium is selected from the group consisting of carbon dioxide, carbon monoxide, nitrogen and argon.

9. A method, as claimed in claim 1, wherein said heat transfer medium comprises carbon dioxide.

10. A method, as claimed in claim 1, wherein said heat transfer medium comprises liquid carbon dioxide.

11. A method, as claimed in claim 1, wherein said heat transfer medium comprises solid carbon dioxide.

12. A method, as claimed in claim 1, wherein said heat transfer medium comprises liquid nitrogen.

13. A method, as claimed in claim 1, further comprising removing particles of said fuel material having a particle size of less than about 5 millimeter.

14. A method, as claimed in claim 1, further comprising compacting said solid fuel material.

15. A method, as claimed in claim 1, further comprising compacting said solid fuel material to a bulk density of greater than about 700 $kg/m^3$.

16. A method, as claimed in claim 1, further comprising compacting said solid fuel material to a bulk density of greater than about 1000 $kg/m^3$.

17. A method, as claimed in claim 1, wherein said solid fuel material has a rate of loss of heating value of less than about 0.5%/month.

18. A method, as claimed in claim 1, wherein said solid fuel material has a rate of loss of heating value of less than about 0.1%/month.

19. A method, as claimed in claim 1, wherein said solid fuel material has a rate of loss of heating value of less than about 0.05%/month.

20. A method, as claimed in claim 1, wherein said step of contacting said heat transfer medium and said solid fuel material displaces ambient air from contact with said fuel material.

21. A method, as claimed in claim 1, wherein said heat transfer medium reacts with the surface of said solid fuel material to passivate said solid fuel material from oxidation by ambient air.

22. A method, as claimed in claim 1, wherein said step of contacting comprises contacting said heat transfer medium with said solid fuel material during crushing of said solid fuel material.

23. A method, as claimed in claim 1, wherein said step of contacting comprises contacting said heat transfer medium with said solid fuel material during a material handling or processing operation.

24. A method, as claimed in claim 1, wherein said step of contacting comprises contacting said heat transfer medium with said solid fuel material while said solid fuel material is in a static condition.

25. A composition comprising:

a solid fuel material, comprising particles having a size of greater than about 5 mm; and a heat transfer medium being in direct contact with said solid fuel material, wherein said composition has a temperature below about 10° C. and said heat transfer medium is not air.

26. A composition as claimed in claim 25, wherein the temperature of said solid fuel material is reduced to below about 5° C.

27. A composition, as claimed in claim 25, wherein the temperature of said solid fuel material is reduced to be between about 0° C. and about 3° C.

28. A composition, as claimed in claim 25, wherein said solid fuel material is selected from the group consisting of coal, upgraded coal products, oil shale, solid biomass materials, refuse-derived fuels, coke, char, petroleum coke, gilsonite, distillation by-products, wood by-product wastes, shredded tires, peat and waste pond coal fines.

29. A composition, as claimed in claim 25, wherein said solid fuel material comprises coal and wherein said coal is selected from the group consisting of bituminous coal, sub-bituminous coal and lignite.

30. A composition, as claimed in claim 25, wherein said solid fuel material is an upgraded coal product and wherein said upgraded coal product is selected from the group consisting of thermally upgraded products, products beneficiated by specific gravity separation, mechanically cleaned coal products and sized coal products.

31. A composition, as claimed in claim 25, wherein said heat transfer medium is selected from the group consisting of carbon dioxide, carbon monoxide, helium, nitrogen, argon and air.

32. A composition, as claimed in claim 25, wherein said heat transfer medium comprises carbon dioxide.

33. A composition, as claimed in claim 25, wherein said heat transfer medium comprises liquid carbon dioxide.

34. A composition, as claimed in claim 25, wherein said solid fuel material has a rate of loss of heating value of less than about 0.5%/month.

35. A composition, as claimed in claim 25, wherein said solid fuel material has a rate of loss of heating value of less than about 0.1%/month.

36. A composition, as claimed in claim 25, wherein said solid fuel material has a rate of loss of heating value of less than about 0.05%/month.

37. A method to reduce oxidative deterioration of a bulk material comprising particles having a size of less than 5 mm, said method comprising the steps of:

directly contacting said bulk material with a heat transfer medium; and reducing a temperature of said bulk material below about 10° C. through said contacting step.

38. A method, as claimed in claim 37, wherein the temperature of said bulk material is reduced to below about 5° C.

39. A method, as claimed in claim 37, wherein the temperature of said bulk material is reduced to be between about 0° C. and about 3° C.

40. A method, as claimed in claim 37, wherein said bulk material comprises a bulk food or agricultural product.

41. A method, as claimed in claim 40, wherein said bulk food product is selected from the group consisting of wheat, corn, soybeans, barley, oats and animal feed.

42. A method, as claimed in claim 40, wherein said bulk material is a carbon containing material selected from the group consisting of activated carbon and carbon black.

* * * * *

UNITED STATES PATENT AND TRADEMARK OFFICE

CERTIFICATE OF CORRECTION

PATENT NO. : 5,725,613

DATED : March 10, 1998

INVENTOR(S) : Reeves et al

It is certified that error appears in the above-identified patent and that said Letters Patent is hereby corrected as shown below:

Column 9, line 3, after nitrogen delete "," and insert --and--.

Column 9, line 4, delete --and air--.

Column 10, line 25, after nitrogen delete "," and insert --and--.

Column 10, line 26, delete --and air--.

Signed and Sealed this

Twenty-seventh Day of April, 1999

*Attest:*

Q. TODD DICKINSON

*Attesting Officer*

*Acting Commissioner of Patents and Trademarks*